US012484756B2

(12) United States Patent
Brewer et al.

(10) Patent No.: US 12,484,756 B2
(45) Date of Patent: Dec. 2, 2025

(54) DISHWASHING APPLIANCE AND SOUND REDUCTION

(71) Applicant: Haier US Appliance Solutions, Inc., Wilmington, DE (US)

(72) Inventors: Kyle James Brewer, Louisville, KY (US); Benjamin Carl Maddux, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 134 days.

(21) Appl. No.: 18/515,135

(22) Filed: Nov. 20, 2023

(65) Prior Publication Data

US 2025/0160604 A1 May 22, 2025

(51) Int. Cl.
*A47L 15/42* (2006.01)

(52) U.S. Cl.
CPC ..... *A47L 15/4209* (2016.11); *A47L 15/4225* (2013.01); *A47L 15/4246* (2013.01); *A47L 15/4251* (2013.01)

(58) Field of Classification Search
None
See application file for complete search history.

(56) References Cited

U.S. PATENT DOCUMENTS

| | | | |
|---|---|---|---|
| 4,359,250 | A | 11/1982 | Jenkins |
| 5,860,436 | A | 1/1999 | Hobday |
| 8,020,662 | B1 | 9/2011 | Colon et al. |
| 8,613,289 | B2 | 12/2013 | Tameishi et al. |
| 9,603,500 | B2 | 3/2017 | Hering et al. |
| 10,093,073 | B2 | 10/2018 | Parloo et al. |
| 11,406,242 | B2 | 8/2022 | Dirisala et al. |

FOREIGN PATENT DOCUMENTS

| | | | |
|---|---|---|---|
| CN | 111110139 | A | 5/2020 |
| CN | 214434086 | U | 10/2021 |

*Primary Examiner* — Levon J Shahinian
(74) *Attorney, Agent, or Firm* — Dority & Manning, P.A.

(57) ABSTRACT

A dishwashing appliance may include a housing frame, a wash tub, a damper brace, and a damper pad. The housing frame may define a bottom end of the dishwashing appliance. The wash tub may be supported on the housing frame. The wash tub may extend along a vertical direction between an upper end and a lower end. The wash tub may extend along a transverse direction between a rearward end and a forward end. The wash tub may define a wash chamber and a front opening to the wash chamber for receipt of articles for washing. The damper brace may be disposed above the bottom end and below the wash chamber. The damper pad may be held between the damper brace and an outer surface of the wash tub in contact with the wash tub proximal to the forward end.

20 Claims, 6 Drawing Sheets

DISHWASHING APPLIANCE AND SOUND REDUCTION

FIELD OF THE DISCLOSURE

The present subject matter relates generally to dishwashing appliance, and more particularly to reduced sound generation in a dishwashing appliance.

BACKGROUND OF THE DISCLOSURE

Dishwashers or dishwashing appliances generally include a tub that defines a wash chamber for receipt of articles for washing. A door provides or permits selective access to the wash chamber. During wash and rinse cycles, dishwashing appliances generally circulate a fluid through a wash chamber over articles, such as pots, pans, silverware, etc. The fluid can be, for example, various combinations of water and detergent during the wash cycle or water (which may include additives) during the rinse cycle. After the rinse cycle is complete, a drain cycle can be performed to remove the fluid from the wash chamber. Typically, one or more pumps are provided to motivate the fluid through or from the wash chamber. For example, the fluid within a dishwashing appliance is typically circulated during a given cycle using a circulation pump. Fluid is collected in a sump at or near a bottom of the wash chamber and pumped back into the wash chamber through, for example, nozzles in spray arms and other openings that direct the fluid against the articles to be cleaned or rinsed. After the rinse cycle is complete, the drain pump may be activated to pump fluid out of the wash chamber.

One of the issues that can arise during use relates to noise and vibrations (e.g., generated by the motor of the pump). Certain frequencies (e.g., around 120 Hz) can be especially problematic, for instance, due to the increased amplitude attributable to the natural frequency of various portions of the dishwashing appliance, or the dishwashing appliance in general. In the past, attempts have been made to mitigate noise or vibrations with insulating material (e.g., foam or sheets) applied to the outside of the tub. However, such attempts have often resulted in manufacturing complexity or increased product costs. Moreover, such attempts often have had limited effect on, for instance, vibrations at 120 Hz.

As a result, appliances or features for addressing one or more of the above issues would be useful. In particular, it may be advantageous to provide a dishwashing appliance or assembly to mitigate noise or vibrations in a system (e.g., robustly, effectively across various frequencies, or without significantly increasing manufacturing difficulties).

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a housing frame, a wash tub, a damper brace, and a damper pad. The housing frame may define a bottom end of the dishwashing appliance. The wash tub may be supported on the housing frame. The wash tub may extend along a vertical direction between an upper end and a lower end. The wash tub may extend along a transverse direction between a rearward end and a forward end. The wash tub may define a wash chamber and a front opening to the wash chamber for receipt of articles for washing. The damper brace may be disposed above the bottom end and below the wash chamber. The damper pad may be held between the damper brace and an outer surface of the wash tub in contact with the wash tub proximal to the forward end.

In another exemplary aspect of the present disclosure, a dishwashing appliance is provided. The dishwashing appliance may include a housing frame, a wash tub, a damper brace, and a damper pad. The housing frame may define a bottom end of the dishwashing appliance. The wash tub may be supported on the housing frame. The wash tub may extend along a vertical direction between an upper end and a lower end. The wash tub may extend along a transverse direction between a rearward end and a forward end. The wash tub may define a wash chamber, a sump below the wash chamber, and a front opening to the wash chamber for receipt of articles for washing. The damper brace may be disposed above the bottom end and below the wash chamber. The damper pad may be held between the damper brace and an outer surface of the wash tub in vertically biased contact with the wash tub forward from the sump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
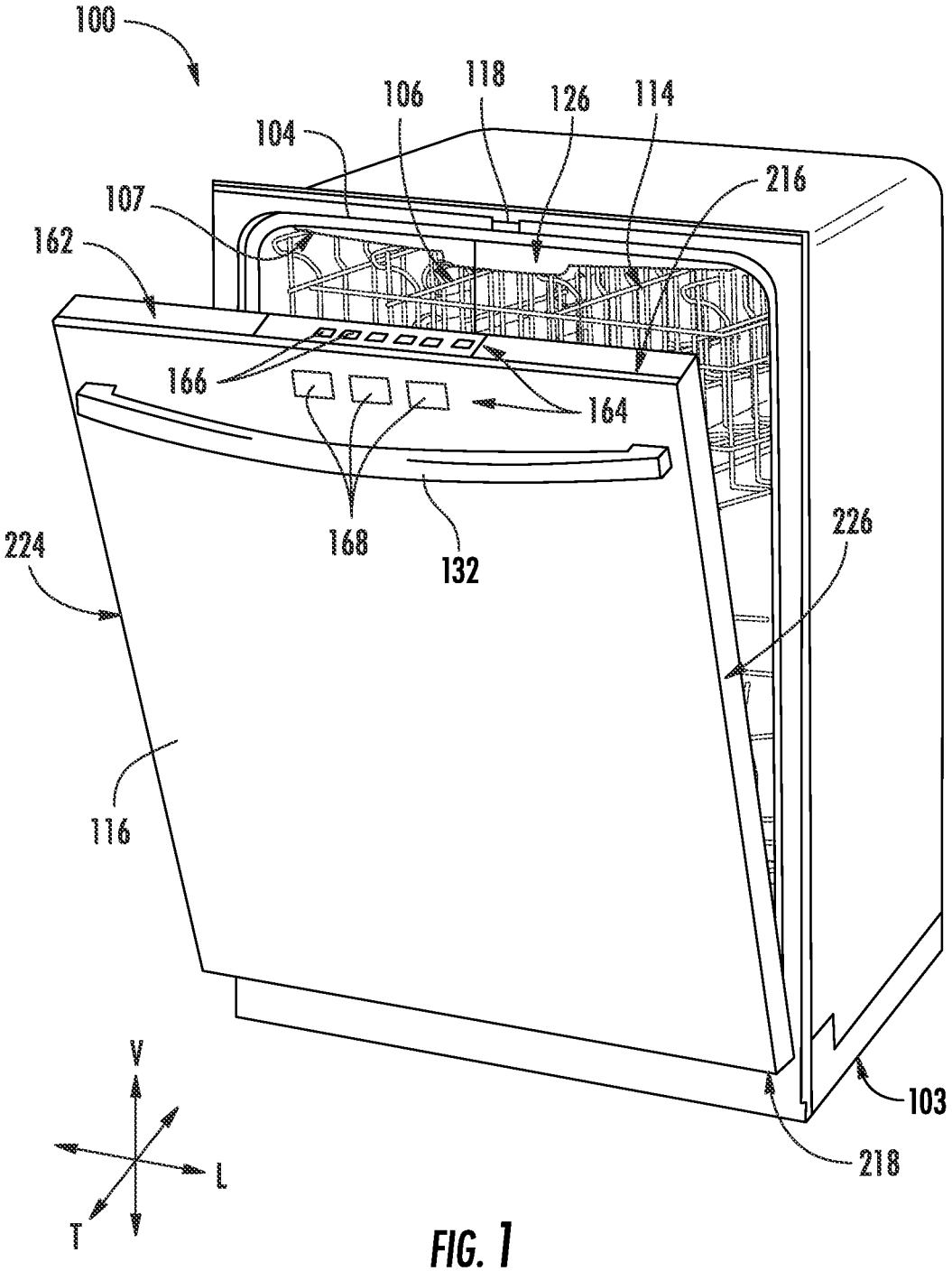
FIG. 1 provides a perspective view of a dishwashing appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Figure 2:
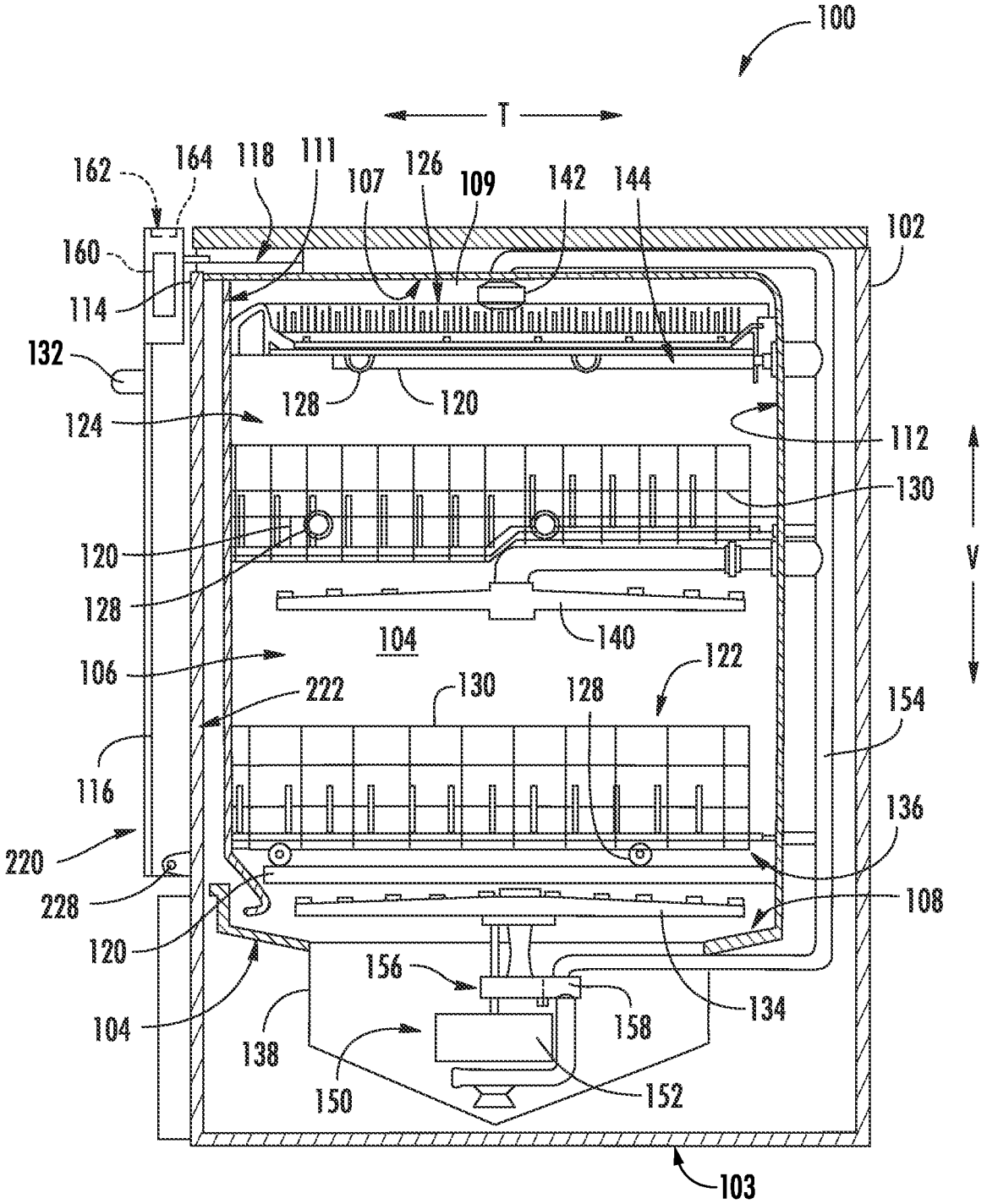
FIG. 2 provides a cross-sectional elevation view of the exemplary dishwashing appliance of FIG. 1.
Figure 3:
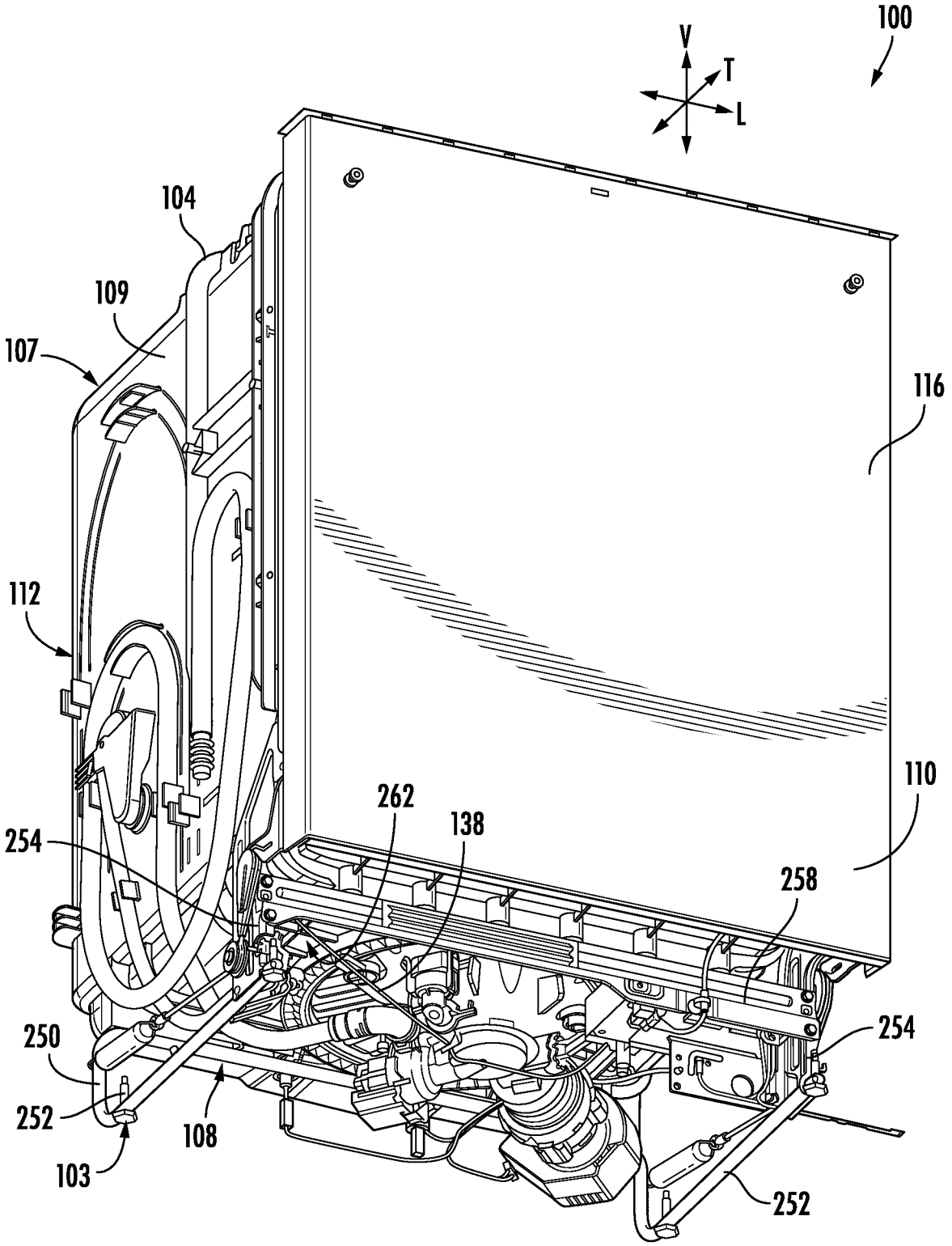
FIG. 3 provides a perspective view of a dishwashing appliance according to exemplary embodiments of the present disclosure.
Figure 4:
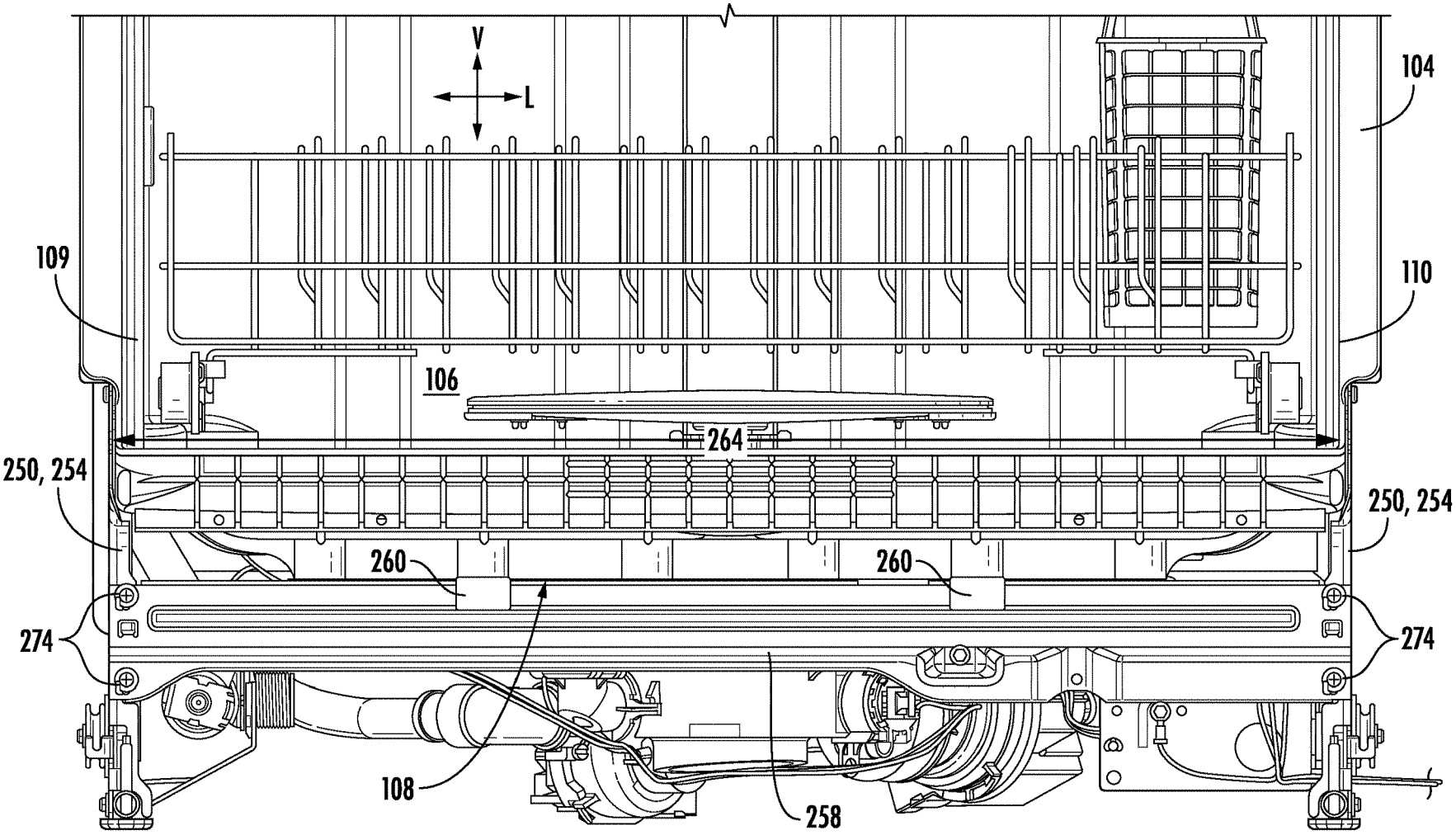
FIG. 4 provides an elevation view of a portion of the exemplary dishwashing appliance of FIG. 3.
Figure 5A:
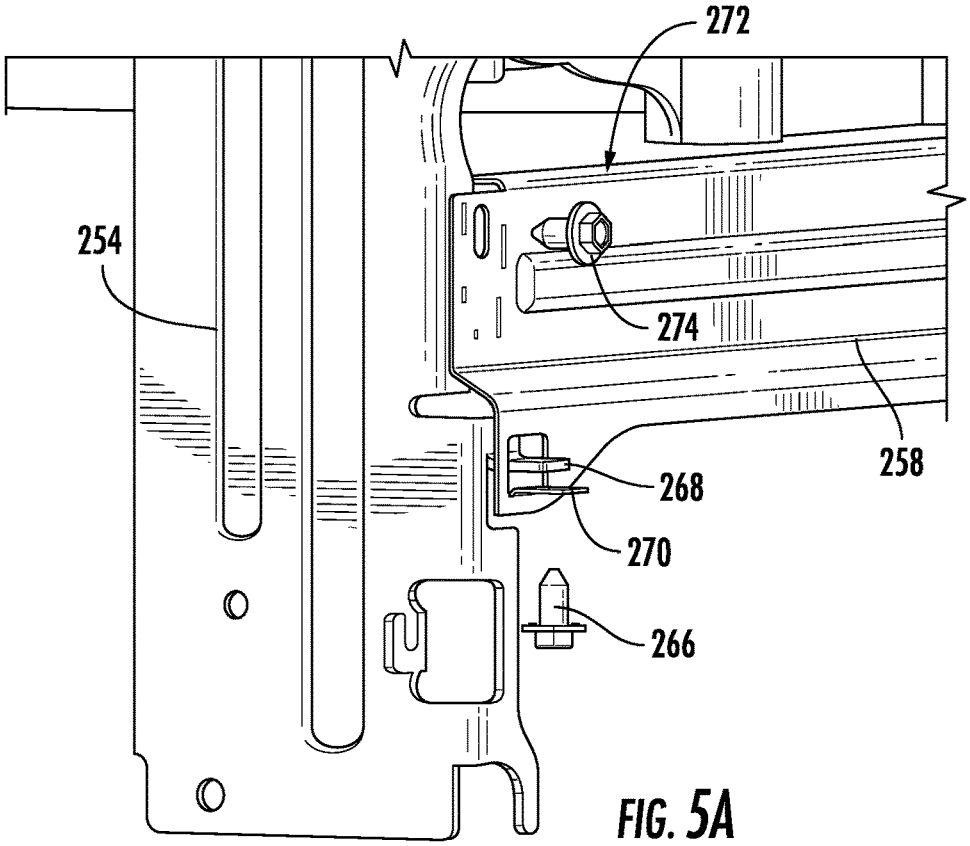
FIG. 5A provides a perspective view of a portion of a dishwashing appliance according to exemplary embodiments of the present disclosure.
Figure 5B:
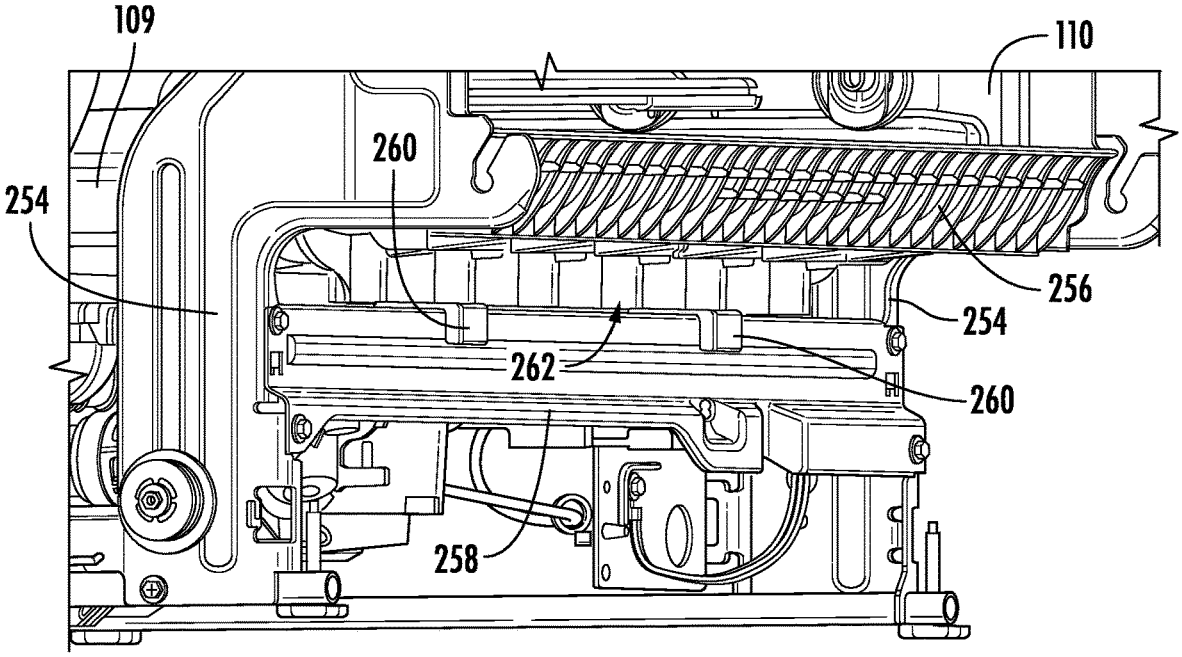
FIG. 5B provides another perspective view of a portion of a dishwashing appliance according to exemplary embodiments of the present disclosure.
Figure 6:
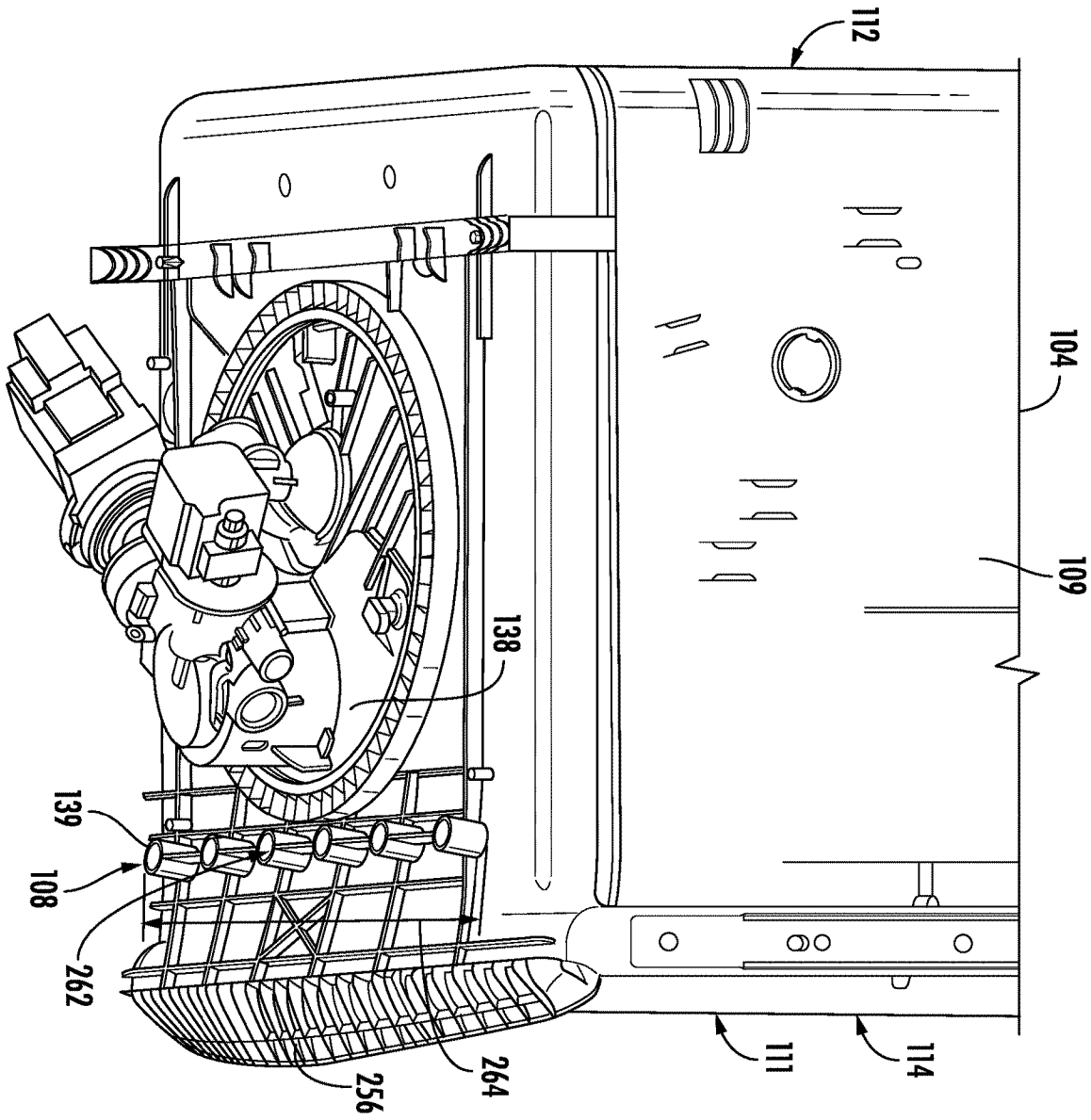
FIG. 6 provides a perspective view of a tub of a dishwashing appliance according to exemplary embodiments of the present disclosure.

Referring now to the figures, an exemplary appliance will be described in accordance with exemplary aspects of the present subject matter. Specifically, FIG. 1 provides a perspective view of an exemplary dishwasher or dishwashing appliance 100 and FIG. 2 provides a side cross-sectional view of appliance 100. As illustrated, appliance 100 generally defines a vertical direction V, a lateral direction L, and a transverse direction T, each of which is mutually perpendicular, such that an orthogonal coordinate system is generally defined.

For the particular embodiment of FIGS. 1 and 2, the dishwasher 100 includes a cabinet 102 having a tub 104 therein that defines a wash chamber 106. Cabinet 102 is generally configured for containing or supporting various components of appliance 100 and which may also define one or more internal chambers or compartments of appliance 100. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). For instance, cabinet 102 may include or be provided as a housing frame 250, as will be described in greater detail below. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As shown, tub 104 extends between an upper end 107 and a lower end 108 along a vertical direction V, between a pair of lateral sides or side walls 109, 110 along a lateral direction L, and between a forward end 111 and a rearward end 112 along a transverse direction T. Each of the vertical direction V, lateral direction L, and transverse direction T are mutually orthogonal to one another. In general, terms such as "left," "right," "front," "rear," "top," or "bottom" are used with reference to the perspective of a user accessing appliance 100.

Along with wash chamber 106, wash tub 104 defines a front opening 114 to the wash chamber 106 for the receipt of articles for washing. A door 116 (e.g., mounted to cabinet 102) may be hinged at its bottom for movement between a normally closed vertical position (shown in FIG. 2), wherein the wash chamber 106 is sealed shut for washing operation, and a horizontal open position for loading and unloading of articles from the dishwasher 100. In the normally closed position, door 116 extends from a top end 216 to a bottom end 218 along the vertical direction V; from a front end 220 to a rear end 222 along the transverse direction T; and between two lateral ends 224, 226 along the lateral direction L. A pivot axis 228 may be defined on the door 116 (e.g., by one or more lateral pivot hinges or pins), for example, parallel to the lateral direction L at or proximal to bottom end 218. A handle 132 may be provided (e.g., proximal to top end 216. According to exemplary embodiments, dishwasher 100 further includes a door closure mechanism or assembly 118 that is used to lock and unlock door 116 for accessing and sealing wash chamber 106.

As illustrated in FIG. 2, tub sides 109, 110 may accommodate a plurality of rack assemblies. More specifically, guide rails 120 may be mounted to sides 109, 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the wash tub 104. More specifically, fluid circulation assembly 150 includes a pump 152 for circulating water or wash fluid (e.g., detergent, water, or rinse aid) in the wash tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. As shown, one or more user inputs 166 (e.g., buttons) of user interface 164 may be positioned at a top end 216 of door 116 (e.g., on or through a top wall of door 116). The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that, except as otherwise specified, the present disclosure is not limited to any particular style, model, or configuration of appliance dishwasher 100. The exemplary embodiment depicted in FIGS. 1 and 2 is for illustrative purposes only.

Turning now generally to FIGS. 3 through 6, various views of portions of dishwashing appliance 100 according to exemplary embodiments of the present disclosure are provided. As noted above, dishwashing appliance 100 generally includes a housing or cabinet 102. In certain embodiments, a housing frame 250 is provided as or as part of cabinet 102 and supports one or more elements (e.g., supporting tub 104) of dishwashing appliance 100. As shown, housing frame 250 may generally define a bottom end 103 of the dishwashing appliance 100. For instance, one or more legs or brackets 252 may be provided in attachment to wash tub 104. Such legs or brackets 252 may be provided on opposite lateral sides of tub 104. In turn, at least one leg or bracket 252 may be attached to tub 104 at first lateral side 109 while at least one other leg or bracket 252 may be attached to tub 104 at second lateral side 110. When assembled, the legs or brackets 252 may hold wash tub 104 off the ground or support surface. Thus, the lower end 108 of wash tub 104 may be vertically spaced apart from the ground or support surface on which the housing frame 250 (or dishwashing appliance 100, generally) rests.

In specific embodiments, a pair of lateral support brackets 254 are included with housing frame 250 (e.g., outside of the wash chamber 106). Such lateral support brackets 254 may be affixed (e.g., directly via one or more suitable adhesives, mechanical fasteners, etc.) to wash tub 104. In particular, the lateral support brackets 254 may be disposed on opposite lateral sides of wash tub 104. A first and second support bracket 254 may thus be disposed at the first and second lateral side 109, 110, respectively (i.e., with the first support bracket 254 disposed at the first lateral side 109 and the second support bracket 254 disposed at the second lateral side 110). The support brackets 254 may each extend below wash tub 104 or wash chamber 106 (e.g., to a lower height or position relative to the vertical direction V). In some embodiments, the support brackets 254 are disposed proximal to the forward end 111 of wash tub 104 (e.g., distal to rearward end 112), such as forward from the sump 138 relative to the transverse direction T. Optionally, the support brackets 254 may be disposed rearward from a front lip 256 of wash tub 104.

In some embodiments, a damper brace 258 is attached (e.g., directly or indirectly) to housing frame 250. Generally, damper brace 258 is provided as a rigid member (e.g., formed as a solid unit, such as from a rigid metal), and may further be an integral or unitary body. In some embodiments, damper brace 258 includes or is provided as a metal plate that is substantially inelastic and unmoving relative to the housing frame 250 or wash tub 104.

When assembled, damper brace 258 may be in a generally fixed position relative to at least a portion of housing frame 250 or wash tub 104. Optionally, the damper brace 258 may be mounted to the housing frame 250 (e.g., at the support brackets 254). In particular, damper brace 258 may be disposed above bottom end 103. Additionally or alternatively, damper brace 258 may be disposed below (e.g., directly beneath or otherwise at a lower position relative to the vertical direction V) at least a portion of wash tub 104, such as below the wash chamber 106 or lower end 108. Thus, in at least some embodiments, damper brace 258 may be disposed both above bottom end 103 (e.g., above and spaced apart therefrom) and below wash chamber 106. Relative to the transverse direction T, the damper brace 258 may be disposed between the forward end 111 and the rearward end 112. In certain embodiments, damper brace 258 is disposed proximal to forward end 111 (e.g., distal to rearward end 112). As a result, and relative to the transverse direction T, the damper brace 258 may be located at a position that is closer to the forward end 111 than it is to rearward end 112. In specific embodiments, damper brace 258 is further disposed forward from the sump 138 (e.g., a forwardmost portion 139 of sump 138). Thus, the sump 138 may be disposed at the lower end 108 and between the rearward end 112 and the damper brace 258 relative to the transverse direction T. Optionally, the damper brace 258 may be disposed at a location less than 6 inches from the forward end 111.

Attached to or supported on damper brace 258 may be one or more damper pads 260. Such damper pads may be formed from any suitable resilient or elastic dampening material. As an example, damper pad 260 may be formed from or include a polymer foam, polyurethane, or silicone. At least a portion of damper brace 258 may be covered by damper pad 260. For instance, a damper pad 260 may be disposed on the upper edge 272 of damper brace. When assembled, damper pad(s) 260 may be held between the damper brace 258 and an outer surface 262 of the wash tub 104. In some embodiments, the damper pad(s) 260 may generally follow the location of damper brace 258. Thus, each damper pad 260 may be disposed above bottom end 103. Additionally or alternatively, each damper pad 260 may be disposed below (e.g., directly beneath or otherwise at a lower position relative to the vertical direction V) at least a portion of wash tub 104, such as below the wash chamber 106 or lower end 108.

In at least some embodiments, each damper pad 260 may be disposed both above bottom end 103 (e.g., above and spaced apart therefrom) and below wash chamber 106. Relative to the transverse direction T, each damper pad 260 may be disposed between the forward end 111 and the rearward end 112. In certain embodiments, damper brace 258 is disposed proximal to forward end 111 (e.g., distal to rearward end 112). In specific embodiments, each damper pad 260 is further disposed forward from the sump 138 (e.g., a forwardmost portion 139 of sump 138). Optionally, each damper pad 260 may be disposed at a location less than 6 inches from the forward end 111.

At least a portion of damper pad 260 is disposed in contact with wash tub 104. For instance, damper pad 260 may contact wash tub 104 at an outer surface 262 that is defined outside of (e.g., below) wash chamber 106. As shown, damper brace 258 may extend along the lateral direction L. An upper edge 272 of damper brace 258 may hold each damper pad 260 against the wash tub 104 (e.g., such that one or more damper pads 260 contact wash tub 104 at corresponding lateral points). Optionally, an intermediate portion of the wash tub 104 may be contacted. In particular, an intermediate portion of the lateral width 264 of the wash tub 104 (e.g., defined between the first lateral side 109 and the second lateral side 110) may be contacted. As an example, damper pad(s) 260 may be in contact with the wash tub 104 at one or more points at between 10% and 90% of the lateral width 264. As an additional or alternative example, the damper pad(s) 260 may be in contact with the wash tub 104 at one or more points at between 40% and 60% of the lateral width 264. Notably, otherwise substantial vibrations at intermediate portions of the wash tub 104 may be prevented or dampened with the contact from the damper pad(s) 260.

Along with being in contact with wash tub 104, the damper pad(s) 260 may be biased against wash tub 104 (e.g., via damper brace 258). In specific embodiments, damper brace 258 is vertically biased (e.g., upward) toward wash tub 104. Optionally, vertical biasing of damper brace 258 may be facilitated by one or more fasteners. For instance, a plurality of vertically oriented mounting screws 266 may load the damper brace 258 toward the wash tub 104 at the lower end 108. As shown, a horizontal frame tab 268 on (e.g., extending from or formed with) each support bracket 254 may engage or mate to a corresponding horizontal brace tab 270 on (e.g., extending from or formed with) each lateral end of damper brace 258. At least one vertical mounting screw 266 on each lateral end of damper brace 258 may drive the tabs 268, 270 together while further loading the upper edge 272 of damper brace 258 and damper pad(s) 260 into biased engagement with the wash tub 104. Optionally, a plurality of horizontally oriented mounting screws 274 may hold damper brace 258 (e.g., in the transverse direction T) against housing frame 250.

Advantageously, the above-described embodiments may mitigate noise or vibrations in the appliance 100 (e.g., robustly, effectively across various frequencies, or without significantly increasing manufacturing difficulties).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a mutually orthogonal vertical, lateral, and transverse direction, the dishwashing appliance comprising:

a housing frame defining a bottom end of the dishwashing appliance;

a wash tub supported on the housing frame, the wash tub extending along the vertical direction between an upper end and a lower end, the wash tub extending along the transverse direction between a rearward end and a forward end, the wash tub defining a wash chamber and a front opening to the wash chamber for receipt of articles for washing;

a damper brace disposed above the bottom end and below the wash chamber; and a damper pad held between the damper brace and an outer surface of the wash tub in contact with the wash tub proximal to the forward end, wherein the damper pad is disposed on the damper brace, wherein the damper brace is mounted to the housing frame, and wherein the housing frame comprises a pair of support brackets affixed respectively to a first and second lateral side of the wash tub outside of the wash chamber.

2. The dishwashing appliance of claim 1, wherein the wash tub comprises a sump disposed at the lower end and between the rearward end and the damper pad relative to the transverse direction.

3. The dishwashing appliance of claim 1, wherein the damper pad is disposed between the forward end and the rearward end relative to the transverse direction.

4. The dishwashing appliance of claim 1, wherein the damper pad is biased vertically upward against the wash tub.

5. The dishwashing appliance of claim 4, wherein the damper pad comprises polymer foam, polyurethane, or silicone.

6. The dishwashing appliance of claim 4, wherein the damper brace comprises an upper edge holding the damper pad against the wash tub.

7. The dishwashing appliance of claim 1, wherein the wash tub defines a lateral width from a first lateral side to a second lateral side, and wherein the damper pad is in contact with the wash tub at one or more points at between 10% and 90% of the lateral width.

8. The dishwashing appliance of claim 7, wherein the damper pad is in contact with the wash tub at one or more points at between 40% and 60% of the lateral width.

9. A dishwashing appliance defining a mutually orthogonal vertical, lateral, and transverse direction, the dishwashing appliance comprising:

a housing frame defining a bottom end of the dishwashing appliance;

a wash tub supported on the housing frame, the wash tub extending along the vertical direction between an upper end and a lower end, the wash tub extending along the transverse direction between a rearward end and a forward end, the wash tub defining a wash chamber, a sump below the wash chamber, and a front opening to the wash chamber for receipt of articles for washing; and a damper brace disposed above the bottom end and below the wash chamber; and a damper pad held between the damper brace and an outer surface of the wash tub in vertically biased contact with the wash tub forward from the sump, wherein the damper pad comprises polymer foam, polyurethane, or silicone.

10. The dishwashing appliance of claim 9, wherein the damper pad is disposed between the forward end and the rearward end relative to the transverse direction.

11. The dishwashing appliance of claim 9, wherein the damper pad is disposed on the damper brace, and wherein the damper brace is mounted to the housing frame.

12. The dishwashing appliance of claim 11, wherein the housing frame comprises a pair of support brackets affixed respectively to a first and second lateral side of the wash tub outside of the wash chamber.

13. The dishwashing appliance of claim 9, wherein the damper brace comprises an upper edge holding the damper pad against the wash tub.

14. The dishwashing appliance of claim 9, wherein the wash tub defines a lateral width from a first lateral side to a second lateral side, and wherein the damper pad is in contact with the wash tub at one or more points at between 10% and 90% of the lateral width.

15. The dishwashing appliance of claim 14, wherein the damper pad is in contact with the wash tub at one or more points at between 40% and 60% of the lateral width.

16. A dishwashing appliance defining a mutually orthogonal vertical, lateral, and transverse direction, the dishwashing appliance comprising:

a housing frame defining a bottom end of the dishwashing appliance;

a wash tub supported on the housing frame, the wash tub extending along the vertical direction between an upper end and a lower end, the wash tub extending along the transverse direction between a rearward end and a forward end, the wash tub defining a wash chamber and a front opening to the wash chamber for receipt of articles for washing;

a damper brace disposed above the bottom end and below the wash chamber; and a damper pad held between the damper brace and an outer surface of the wash tub in contact with the wash tub proximal to the forward end, wherein the wash tub defines a lateral width from a first lateral side to a second lateral side, and wherein the damper pad is in contact with the wash tub at one or more points at between 10% and 90% of the lateral width.

17. The dishwashing appliance of claim 16, wherein the damper pad is disposed on the damper brace, and wherein the damper brace is mounted to the housing frame.

18. The dishwashing appliance of claim 16, wherein the damper pad comprises polymer foam, polyurethane, or silicone.

19. The dishwashing appliance of claim 16, wherein the damper brace comprises an upper edge holding the damper pad against the wash tub.

20. The dishwashing appliance of claim 16, wherein the damper pad is in contact with the wash tub at one or more points at between 40% and 60% of the lateral width.

* * * * *